US010932551B2

(12) United States Patent
Edgel

(10) Patent No.: US 10,932,551 B2
(45) Date of Patent: Mar. 2, 2021

(54) MODULAR, WEARABLE, ACCESS-CONTROL MANAGEMENT AND STORAGE DEVICE

(71) Applicant: Sophia Edgel, Arlington, VA (US)

(72) Inventor: Sophia Edgel, Arlington, VA (US)

( * ) Notice: Subject to any disclaimer, the term of this patent is extended or adjusted under 35 U.S.C. 154(b) by 0 days.

(21) Appl. No.: 15/920,074

(22) Filed: Mar. 13, 2018

(65) Prior Publication Data

US 2019/0281962 A1 Sep. 19, 2019

(51) Int. Cl.

| | |
|---|---|
| ***A45F 5/02*** | (2006.01) |
| ***A45F 3/00*** | (2006.01) |
| ***A45F 5/00*** | (2006.01) |
| ***B65D 83/08*** | (2006.01) |

(52) U.S. Cl.

CPC ..... *A45F 5/021* (2013.01); *A45F 3/005* (2013.01); *A45F 5/004* (2013.01); *B65D 83/08* (2013.01); *A45F 2003/003* (2013.01); *A45F 2200/0558* (2013.01)

(58) Field of Classification Search

CPC ..... A45F 5/021; A45F 3/005; A45F 5/004; A45F 2200/0558; A45F 2003/003; B65D 83/08

USPC ..... 224/673

See application file for complete search history.

(56) References Cited

U.S. PATENT DOCUMENTS 551,359 A * 12/1895 Braillard ..... A45F 3/005 224/660
1,648,565 A * 11/1927 Primley ..... A63B 47/00 206/315.9
1,762,770 A * 6/1930 Droutman ..... A45C 11/328 206/37.2
2,076,895 A * 4/1937 Johnston ..... A45C 11/328 206/37.2
2,176,677 A * 10/1939 Nash ..... A45C 11/328 206/37.2
2,176,863 A * 10/1939 Nash ..... A45C 11/328 206/37.2
2,242,141 A * 5/1941 Nash ..... A45C 11/328 206/37.6
2,601,331 A * 6/1952 Segal ..... A45C 11/328 206/37.2

(Continued)

FOREIGN PATENT DOCUMENTS

CA 394348 A 1/1941
CA 2187705 C 8/1999

(Continued)

*Primary Examiner* — Nathan J Newhouse
*Assistant Examiner* — Lester L Vanterpool
(74) *Attorney, Agent, or Firm* — Foley & Lardner LLP

(57) ABSTRACT

A wearable, access-control management and storage device includes a belt loop including opposed connectable ends, the belt loop being adjustable in size; a pouch module coupled to the belt loop, the pouch module including an inner surface and an outer surface, the inner surface of the pouch module defining a first storage compartment having an opening and the outer surface defining a front side and a back side of the pouch module; and a plurality of key holders disposed within the first storage compartment of the pouch module, each of the plurality of key holders configured to receive and hold at least one key. The back side of the pouch module includes at least one aperture configured to receive the belt loop.

17 Claims, 9 Drawing Sheets

(56) References Cited

U.S. PATENT DOCUMENTS 2,978,897 A * 4/1961 Capitani ..... A45C 11/323 70/456 R
4,004,325 A * 1/1977 Hubachek ..... A45C 11/323 24/3.6
4,228,836 A * 10/1980 McFarland ..... A45C 11/323 206/37.6
4,331,194 A 5/1982 Lederer
4,488,737 A 12/1984 Jacobs et al.
4,545,414 A * 10/1985 Baum ..... A45C 1/04 150/107
4,576,839 A * 3/1986 Parren ..... A45C 11/328 206/87
4,836,428 A * 6/1989 Evans ..... A45C 1/04 224/240
5,060,835 A * 10/1991 Payne ..... A45F 3/16 224/148.2
5,228,563 A * 7/1993 Stringham ..... A45C 11/328 206/37.2
5,511,704 A * 4/1996 Linderer ..... H04B 1/3888 224/245
5,533,656 A 7/1996 Bonaldi
5,871,132 A 2/1999 Hargreaves
6,237,756 B1 * 5/2001 Caudle ..... A45C 11/328 206/37.2
6,612,350 B1 * 9/2003 Brynjulfsen ..... A45C 3/001 150/118
6,651,854 B1 * 11/2003 LaCoste ..... A45F 5/00 224/196
6,698,636 B2 * 3/2004 Angus ..... A45F 3/00 224/660
6,748,629 B2 * 6/2004 Gould ..... A47G 29/10 24/3.1
6,763,938 B1 * 7/2004 Nelson ..... A45C 11/323 206/37.1
6,874,342 B1 4/2005 Batista
7,937,977 B2 * 5/2011 Booker ..... A45C 11/328 70/456 R
9,295,289 B2 3/2016 James
9,364,122 B2 6/2016 Sohn
9,498,037 B2 11/2016 Rodrigues
2002/0148872 A1 * 10/2002 DeVolentine ..... A45F 3/14 224/665
2003/0164013 A1 9/2003 Florendo
2005/0109827 A1 * 5/2005 Martin ..... B65D 5/5435 229/232
2005/0116462 A1 6/2005 Telleen
2005/0121121 A1 * 6/2005 Wang ..... A45C 5/06 150/117
2005/0238261 A1 * 10/2005 Godshaw ..... A01K 1/0254 383/40
2005/0263087 A1 * 12/2005 Livingston, III ..... E01H 1/1206 119/161
2006/0144106 A1 7/2006 Beresnitzky
2007/0034728 A1 * 2/2007 Moores ..... B65H 39/16 242/588.1
2007/0215663 A1 * 9/2007 Chongson ..... A45C 1/04 224/650
2008/0127461 A1 6/2008 Linden et al.
2008/0173662 A1 * 7/2008 Che ..... B65H 35/10 221/64
2009/0194571 A1 8/2009 Evans
2010/0147855 A1 6/2010 Janssen
2013/0048687 A1 2/2013 Do
2014/0361062 A1 12/2014 Newton
2014/0374281 A1 12/2014 Rodrigues
2015/0075448 A1 * 3/2015 Clark ..... A01K 27/00 119/797
2015/0150421 A1 6/2015 Sohn
2015/0158172 A1 6/2015 Conway et al.
2015/0351524 A1 12/2015 Martinez

FOREIGN PATENT DOCUMENTS

DE 30 37 185 A1 5/1982
DE 19617328 C1 8/1997
EP 1 034 717 A1 9/2000
FR 854254 A 4/1940
FR 952209 A 11/1949
FR 1468218 A 2/1967
FR 2599713 A1 12/1987
FR 2784555 B1 3/2002
FR 2920954 A1 3/2009
FR 2931632 A1 12/2009
GB 0 286 785 A 3/1928
GB 0 765 386 A 1/1957
GB 2 161 700 A 1/1986
JP 3032902 U 1/1997
JP 2003-125830 A 5/2003
JP 2015-165387 A 9/2015
KR 2020090007994 U 8/2009
KR 1020090112974 A 10/2009
KR 200448459 Y1 4/2010
KR 2020100008014 U 8/2010
KR 200453475 Y1 4/2011
KR 2020130006416 U 11/2013
KR 1020140015896 A 2/2014
KR 1020150104071 A 9/2015
KR 1020160015982 A 2/2016
KR 2020170001455 U 4/2017
KR 2020170002965 U 8/2017
WO WO-2008/000528 A1 4/1980
WO WO-99/33370 A1 7/1999
WO WO-2013/149298 A1 10/2013

* cited by examiner

MODULAR, WEARABLE, ACCESS-CONTROL MANAGEMENT AND STORAGE DEVICE

BACKGROUND

The present disclosure relates generally to the field of access-control and management storage devices, in particular to modular storage devices which are wearable by a user.

Users such as maintenance workers, security personnel, care-takers, and pet watchers often need to carry with them keys to multiple locations, such as homes. Accordingly, such users may require a carrying case in which to store the keys or related accessories without mixing up the keys or related accessories as the users go from one location to another location. There are a number of carrying cases available for storing items, such as belt packs, carrying cases, backpacks, or satchels. However, many of these carrying cases are cumbersome or bulky, rendering them ill-suited for a user who needs flexibility while performing a particular task, such as pet watching, without requiring the user to be physically separate from the carrying case. Additionally, many of the available carrying cases, belt packs (including fanny packs), and backpacks do not include compartments configured to receive and hold a relatively large number of keys in a way that keeps the keys separate from each other and yet readily accessible.

Although pocket-sized key pouches are available and are configured to hold a relatively large number of keys, these key pouches generally are sized to fit into a user's pocket rather than to be worn around the waist of a user. Additionally, the pocket-sized key pouches usually cannot be used to carry related accessories in separate storage compartments because of the relatively small size required for a pocket-sized pouch.

Accordingly, there is a need for a modular storage device which is wearable around a waist of a user and which includes various modules such as a storage compartment configured to receive and hold a relatively large number of keys separate from each other and which may be combined with additional storage or functional compartments configured to hold related accessories (such as bags, stickers, etc.).

SUMMARY

The following presents a general summary of aspects of the present disclosure in order to provide a basic understanding of the disclosure. This summary is not an extensive overview of the disclosure and is not intended to identify key or critical elements of the invention or to delineate the scope of the present disclosure. The following summary merely presents some concepts of the present disclosure in a general form as a prelude to the more detailed description provided below.

According to one exemplary embodiment of the present disclosure, a modular storage device wearable by a user includes a belt loop including opposed connectable ends, the belt loop being adjustable in size; a pouch module coupled to the belt loop, the pouch module including an inner surface and an outer surface, the inner surface of the pouch module defining a first storage compartment having an opening and the outer surface defining a front side and a back side of the pouch module; and a plurality of key holders disposed within the first storage compartment of the pouch module, each of the plurality of key holders configured to receive and hold at least one key.

According to one aspect of the modular storage device wearable by the user, the at least one aperture configured to receive the belt loop includes two apertures.

According to one aspect of the modular storage device wearable by the user, each of the plurality of key holders is a retractable key holder.

According to one aspect of the modular storage device wearable by the user, the retractable key holder includes a clip configured to receive and hold a key.

According to one aspect of the modular storage device wearable by the user, the plurality of key holders are arranged in an array.

According to one aspect of the modular storage device wearable by the user, the array is a 2×5 array.

According to one aspect of the modular storage device wearable by the user, the pouch module includes a second storage compartment.

According to one aspect of the modular storage device wearable by the user, the storage device also includes a bag dispenser module coupled to the belt loop or the pouch module.

According to one aspect of the modular storage device wearable by the user, the storage device also includes a sticker dispenser module coupled to the belt loop or the pouch module.

According to one aspect of the modular storage device wearable by the user, the pouch module includes a flap configured to cover the opening of the first storage compartment, the flap including a sleeve configured to hold a writing instrument.

According to one aspect of the modular storage device wearable by the user, the storage device also includes a second pouch module configured to be attachable to the belt loop, the second pouch module including an inner surface and an outer surface, the inner surface of the second pouch module defining a storage compartment having an opening and the outer surface defining a front side and a back side of the second pouch module; and a plurality of key holders disposed within the storage compartment of the second pouch module, each of the plurality of key holders configured to receive and hold at least one key. The back side of the second pouch module includes at least one aperture configured to receive the belt loop.

A wearable, access-control management and storage device includes a strap configured to be worn by a user; a pouch module coupled to the strap, the pouch module including an inner surface and an outer surface, the inner surface of the pouch module defining a storage compartment having an opening and the outer surface defining a front side and a back side of the pouch module; a removable platform housed within the pouch module, the removable platform configured to support a plurality of retractable key holders, each of the plurality of key holders configured to receive and hold at least one key.

According to another exemplary embodiment of the present disclosure, a method of providing a modular, wearable storage and access-control device is provided. The method includes the steps of providing a belt loop including opposed connectable ends, the belt loop being adjustable in size; providing a pouch module attached to the belt loop, the pouch module including an inner surface and an outer surface, the inner surface of the pouch module defining a first storage compartment having an opening and the outer surface defining a front side and a back side of the pouch module, the back side including at least one aperture configured to receive the belt loop; and providing an array of key holders disposed within the first storage compartment of the pouch module, each of the key holders configured to receive and hold at least one key.

According to one aspect of the method, the at least one aperture configured to receive the belt loop includes two apertures.

According to one aspect of the method, each of the key holders is a retractable key holder.

According to one aspect of the method, the array of key holders is a 2×5 array.

According to one aspect of the method, the pouch module includes a second storage compartment.

According to one aspect of the method, the method also includes providing a bag dispenser module releasably attached to the belt loop.

According to one aspect of the method, the method also includes providing a sticker dispenser module releasably attached to the belt loop.

According to one aspect of the method, the pouch module includes a flap configured to cover the opening of the first storage compartment, the flap including a sleeve configured to hold a writing instrument.

BRIEF DESCRIPTION OF THE DRAWINGS

The accompanying drawings are not intended to be drawn to scale. Like reference numbers and designations in the various drawings indicate like elements. For purposes of clarity, not every component may be labeled in every drawing. In the drawings.

DETAILED DESCRIPTION

Figure 1:
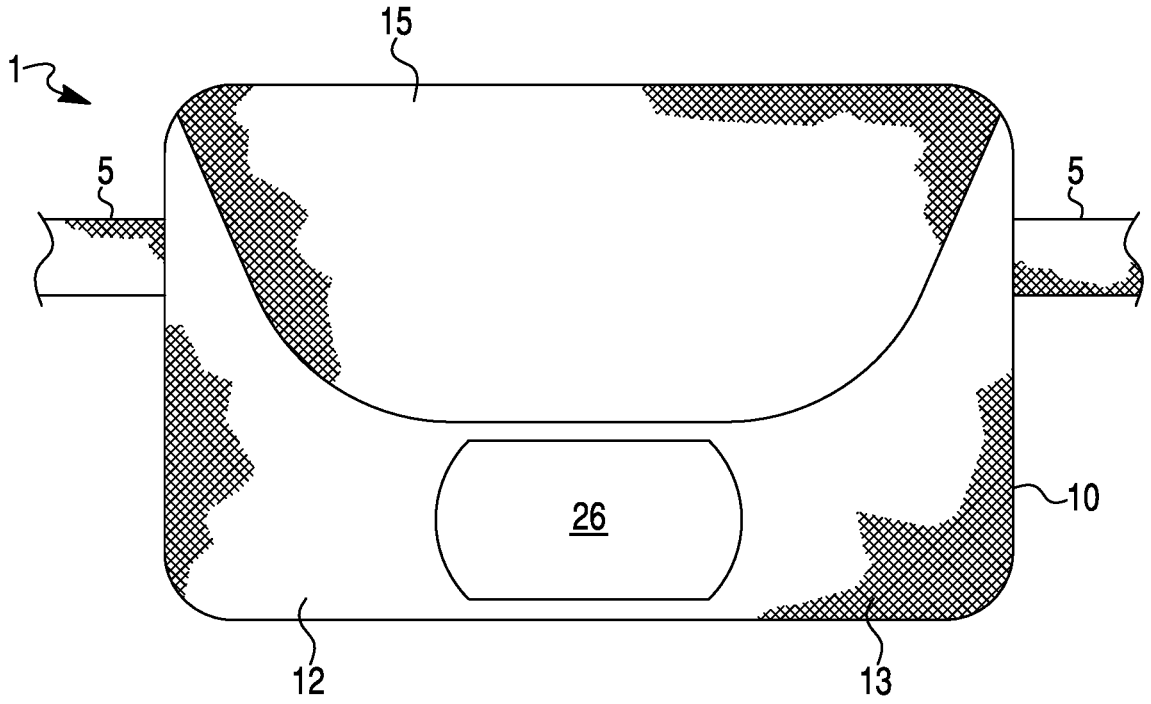
FIG. 1 is a front elevation view of a wearable storage device, according to an exemplary embodiment.

Referring generally to the FIGURES, a modular, wearable, access-control storage device 1 is shown. The storage device 1 includes a belt loop 5 which is configured to worn around a waist of a user, such as a housekeeper, a pet watcher, a care-taker, a maintenance worker, security personnel etc. The storage device 1 also includes a pouch 10 attachable to the belt loop which includes a storage compartment 20. According to some aspects, the storage device 1 also includes multiple pouches 10 attachable to the belt loop. According to other aspects, the storage device 1 also includes additional modules, such as storage compartments, which are attachable to the belt loop 5.

Figure 4:
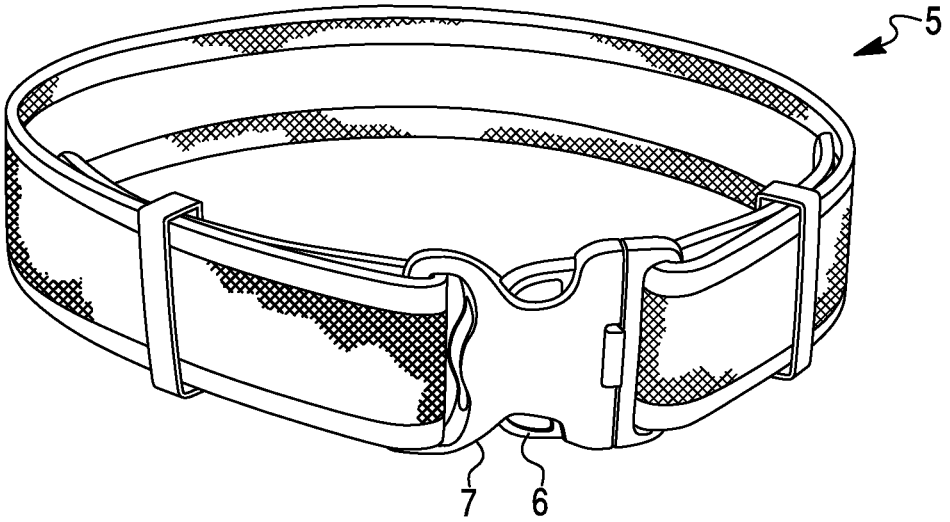
FIG. 4 is a perspective view of a belt loop useable with the wearable storage device shown in FIG. 1.

As shown in FIG. 1, a storage device 1, which is configured to be worn around a waist of a user, includes a belt loop 5. As shown in FIG. 4, the belt loop 5 includes two opposed connectable ends 6, 7. Although FIG. 4 shows connectable end 6 as a male connector and connectable end 7 as a female connector, the belt loop 5 is not particularly limited to this implementation. The belt loop 5 is adjustable in size such that a user can adjust a size of the belt loop 5 to correspond to a size of the user's waist or hips such that the belt loop 5 can fit around the user's waist and/or hips. The belt loop 5 may be any commercially available belt loop.

Figure 2A:
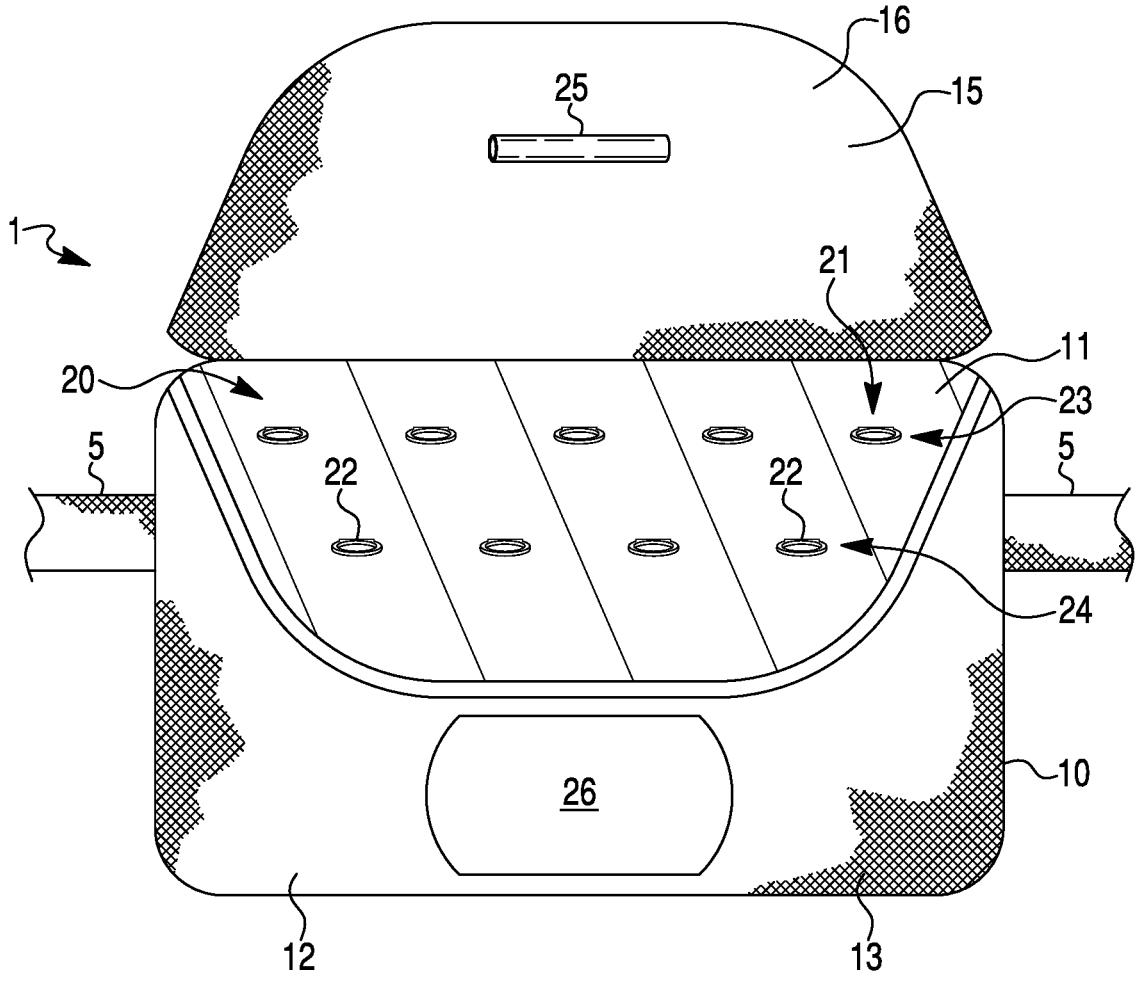
FIG. 2A is a front elevation view of the wearable storage device shown in FIG. 1 showing an interior portion of the wearable storage device.
Figure 2B:
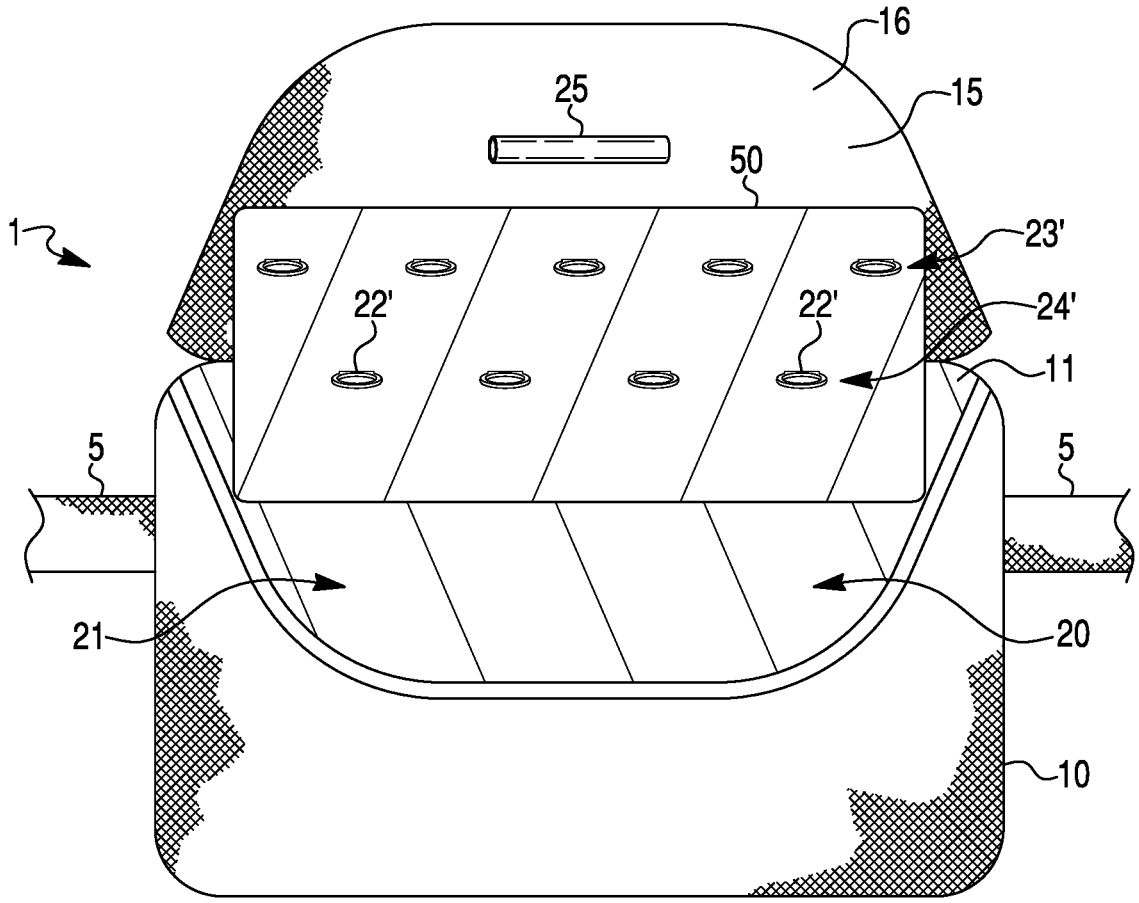
FIG. 2B is an exploded assembly view of the wearable storage device shown in FIG. 1, according to one aspect.
Figure 3:
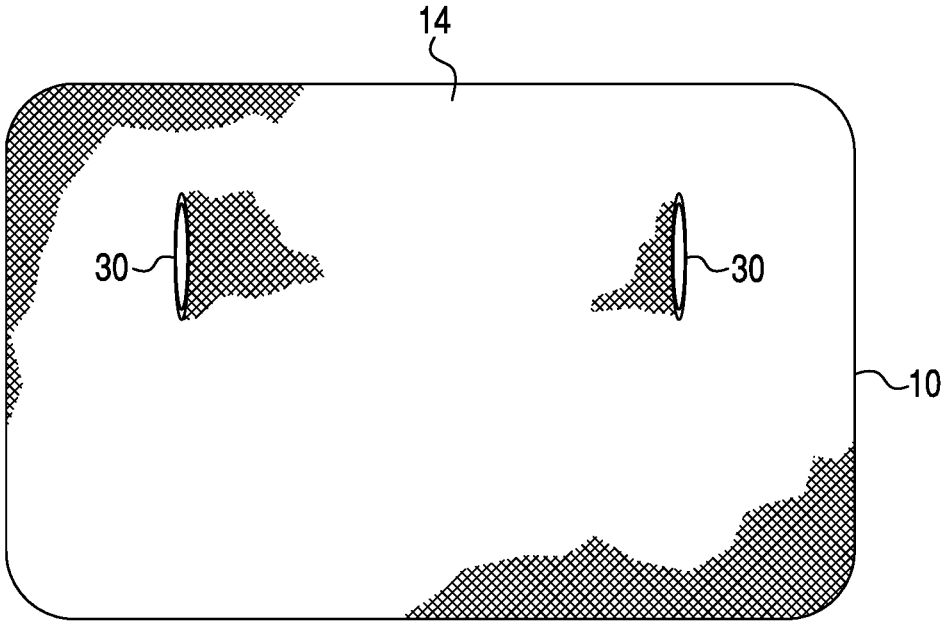
FIG. 3 is a rear elevation view of the wearable storage device shown in FIG. 1.

Referring to FIGS. 1-3, the storage device 1 includes a primary module shown as pouch 10. The pouch 10 is made of any suitable material, for example, cloth or leather. The pouch 10 is of any suitable size and/or shape. For example, the pouch 10 is sized to extend across at least a portion of the waist of a user. As another example, the pouch 10 is sized to extend across an entirety of the waist of the user. As yet another example, the pouch 10 is pocket-sized such that the pouch 10, when not attached to the belt loop 5, can fit within a pocket of a garment worn by the user, for example, a conventionally sized pocket on a pair of pants worn by the user.

The pouch 10 includes an outer surface 12 which defines a front side 13 and a back side 14 of the pouch 10. As shown in FIG. 3, the back side 14 includes apertures 30. The apertures 30 are configured to receive the belt loop 5 such that the belt loop 5 is inserted into the apertures 30, thereby securably attaching the pouch 10 to the belt loop 5. Although FIG. 3 shows the back side 14 as including two apertures 30, the present disclosure is not particularly limited to this particular implementation. As other examples, the back side 14 of the pouch 10 includes one, two, three, four, or five apertures 30. The apertures 30 of the pouch 10 allow for the pouch 10 to be inserted and/or removed from a belt loop 5, according to the needs or desires of a particular user. According to one aspect, therefore, the pouch 10 is removably attachable to the belt loop 5. According to another aspect, the pouch 10 is integrally formed with the belt loop 5.

Figure 10:
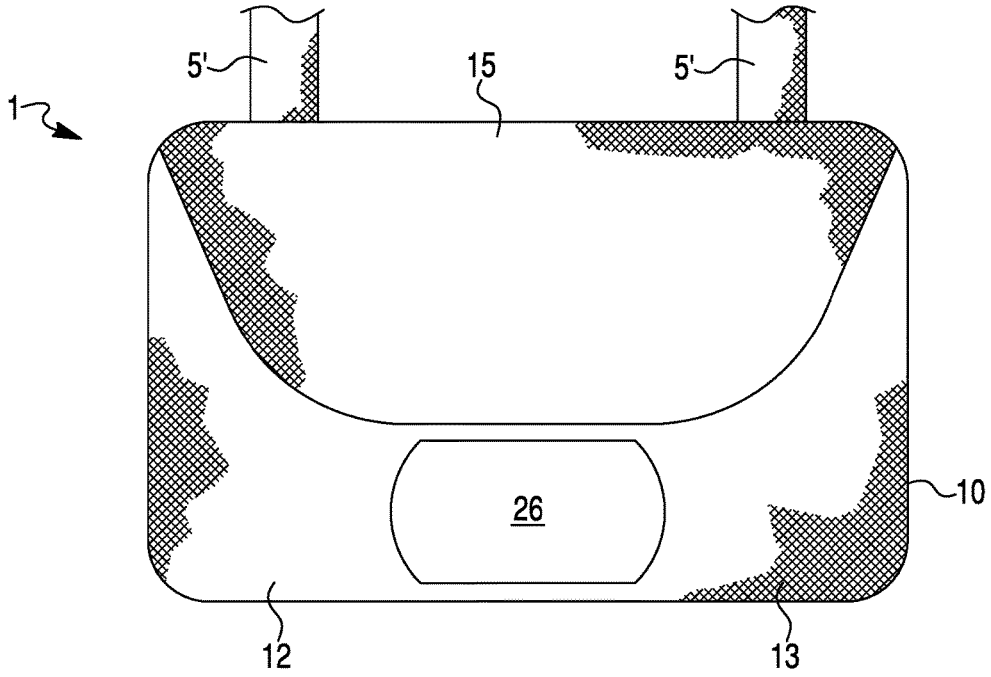
FIG. 10 is a front elevation view of a wearable storage device, according to an exemplary embodiment.

Although the storage device 1 shown in FIGS. 1-3 is shown to be configured to be worn around the user's waist and/or hips, the present invention is not limited to this particular implementation. For example, as shown in FIG. 10, the storage device includes a strap 5' configured to be worn by a user around and/or over the user's arm and/or shoulder. Although FIG. 10 shows one strap 5', the storage device 1 in this embodiment is not particularly limited to this implementation. For example, the storage device 1 may include one, two, three, or more straps 5' which are configured to be worn by the user around and/or over at least one of the user's arms and/or shoulders. In the embodiment shown in FIG. 10, the pouch 10 includes the apertures 30 (shown in FIG. 3) except that the placement and/or orientation of the apertures 30 on the back side 14 of the pouch 10 shown in FIG. 10 may be different than the placement and/or orientation shown in FIG. 3 to allow the storage device 1 shown in FIG. 10 to be wearable around and/or over at least one of the user's arms and/or shoulders.

Figure 5:
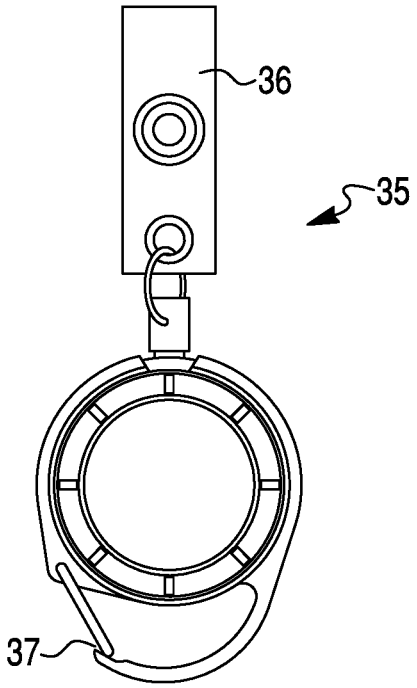
FIG. 5 is a side view of a key holder useable with the wearable storage device shown in FIG. 1.

Referring now to FIG. 2A, the pouch 10 also includes a back panel with an inner surface 11. The inner surface 11 defines a storage compartment 20 having an opening 21. The storage compartment 20 is configured to store a predetermined number of keys separately from each other. The storage compartment 20 is also configured to store related accessories. The storage compartment 20 includes a predetermined number of connectors 22 (e.g., snap fit connectors, etc.); each of the connectors 22 is configured to be attached to a key holder, such as key holder 35 shown in FIG. 5. The key holder 35 shown in FIG. 5 is a retractable/extendable key holder but the present disclosure is not particularly limited to that implementation. The key holder 35 is attachable to the connector 22 using the connector 36. As shown in FIG. 5, the connector 36 is shown as a snap-fit connector (e.g., snap fastener) 36, but the present disclosure is not particularly limited to this implementation. By using the key holder 35, the pouch 10 is configured to store a predetermined number of keys (such as one key per key holder 35) such that each key is securably held within the pouch 10 separate from all of the other keys stored in the pouch 10. A key is attachable to the key holder 35 using the clip 37 of the key holder 35. By depressing the lever arm of the clip 37, a user can insert and/or remove a key from the key holder 35. Accordingly, the pouch 10 enables a user to prevent an assortment of keys or related accessories from jumbling together which makes it difficult for the user to procure a particular key when the user desires. Additionally, in the example in which the key holder 35 is an extendable and/or retractable key holder, the pouch 10 allows a user to access and use a key attached to the extendable and/or retractable key holder without first removing the key from the key holder 35. In this manner, the pouch 10 ensures that the key will remain connected to the storage device 1 at all times during use to prevent the key from falling into any recesses of the pouch 10 or falling out of the pouch 10 onto the ground or into an external location where the key may become lost.

As shown in FIG. 2A, the connectors 22 are disposed on the inner surface 11 of the back panel of the pouch 10. The connectors 22 are arranged in a configuration such that a key may be connected directly or indirectly to each of the connectors 22 without interfering with any other key stored in the storage compartment 20. For example, the connectors 22 are arranged in an array. As a specific example, as shown in FIG. 2A, the connectors 22 are arranged in a 2×5 array, that is, in two rows (e.g., rows 23 and 24) of five connectors each. In the 2×5 array shown in FIG. 2, the upper row 23 of connectors 22 is laterally offset from the lower row 24 of connectors 22. The lateral offset configuration of rows 23 and 24 allows for a more efficient storage of keys. When a key is attached to a key holder 35 attached to one of the connectors 22, the lateral offset configuration of rows 23 and 24 ensures that each key is kept separate from the other keys stored in the pouch 10 and that the key holders 35 do not interfere with each other when a user accesses and/or uses one or more of the keys stored in the pouch 10. However, the orientation or arrangement of the connectors 22 is not limited to this particular implementation. For example, the connectors 22 are arranged in a 2×6 array, a 2×7 array, a 3×5 array, a 3×6 array, etc. Although the connectors 22 are shown as loops in FIG. 2A, the present disclosure is not particularly limited to this implementation. As another example, the connectors 22 are hooks on which a key holder, such as key holder 35 (shown in FIG. 5) is connectable.

According to another aspect shown in FIG. 2B, the storage device 1 includes a removable platform 50 on and/or in which connectors 22' (e.g., snap-fit connectors, etc.) are mounted and/or disposed. The removable platform 50 is, according to one aspect, a flat platform, and is formed of any suitable material, such as fabric, paper (such as cardboard), nylon, etc. The removable platform 50 is configured to be placed into and/or removed from the storage compartment 20 of the pouch module 10. As one example, the removable platform 50 is attachable to the inner surface 11 of the pouch module 10. As a specific example, the removable platform is attachable to the inner surface 11 of the pouch module 10 using hook and loop fasteners. As another example, the removable platform 50 is configured to be stored loosely within the storage compartment 20. The removable platform 50 may be selectively deployed within the storage compartment 20 of the pouch module 10 to enable a user of the storage device 1 to be able to remove a set of keys pre-attached to the removable platform 50 from the pouch module 10 without having first to detach any of the set of keys from the removable platform 50. In this configuration, functionality of the storage device allows a user to readily switch out sets of keys from the pouch module 10 without the need to remove any of the keys of the set of keys from the removable platform and thereby separate the set of keys and risk separating the keys which constitute the set of keys.

According to one aspect, the connectors 22' of the removable platform 50 are holes disposed within the removable platform 50. The connectors 22' are arranged in any suitable orientation and configuration; for example, the connectors 22' are arranged in two rows 23' and 24' (shown in FIG. 2B), in an array configuration as described above with reference to connectors 22. In this aspect, a key holder, such as the retractable key holder 35 (shown in FIG. 5) is attachable to the removable platform 50, for example, by connecting an end of the key holder 35 (such as either connector 36 or clip 37 of the key holder 35) to one of the connectors 22', and thereby the removable platform 50 is configured to support one or more key holder 35. As another example, the clip 37 of the key holder 35 is placed within one of the connectors 22 (e.g., by placing the clip 37 through the hole) such that the clip 37 is housed between a surface of the removable platform 50 and the inner surface 11 of the pouch module 10. In this example, the connector 36 of the key holder 35 is connected to a key (not shown), thereby allowing a user to store the key within the pouch module 10 and retrieve the key for use while maintaining the key connected to the key holder 35 housed within the storage compartment 20 of the pouch module 10. In this example, individual key holders 35 are easily removable from and/or attachable to the removable platform 50.

As shown in FIGS. 1 and 2A, the pouch module 10 also includes a flap 15 which is configured to cover the opening 21 of the storage compartment 20. The flap 15 is moveable to a first position, shown in FIG. 1, in which the flap 15 covers the opening 21, restricting access to the storage compartment 20. According to one aspect, the flap 15 includes a latch which is attachable to the front side 13 of the pouch 10, thereby securably holding the flap 15 in the first position. According to another aspect, the flap 15 is loose. The flap 15 is also moveable from the first position to a second position, shown in FIG. 2A, in which the flap 15 is withdrawn from the opening 21, allowing a user to access the storage compartment 20 and the contents held therein.

The flap 15 also includes a surface 16 which includes a sleeve 25 formed integrally with the surface 16. The sleeve 25 is configured to hold a writing instrument, such as a pen or a pencil. Although FIG. 2A shows only a single sleeve 25, the present disclosure is not particularly limited to this implementation. For example, the surface 16 of the flap 15 includes two, three, four, or five or more sleeves 25, each sleeve 25 configured to hold a writing instrument.

Referring back to FIG. 1, the pouch module 10 optionally includes a storage compartment 26. As shown in FIG. 1, the storage compartment 26 is disposed on the front side 13 of the pouch 10. The storage compartment 26 is configured to store additional accessories, as desired by the user. The storage compartment 26 includes an opening (not shown) which may be securably closed using any suitable means, such as a zipper, buttons, or other fasteners. Although the storage compartment 26 is shown on the front side 13 of the pouch 10, the storage compartment 26 may be located on any suitable location on the pouch 10, either on the outer surface 12 of the pouch 10 or on the inner surface 11 of the pouch 10.

According to some aspects, the storage device 1 includes a plurality of pouches 10 which are attachable to the belt loop 5. Each of the plurality of pouches are separately and independently attachable to and/or removable from the belt loop 5 based on the needs or desires of a particular user.

Figure 6:
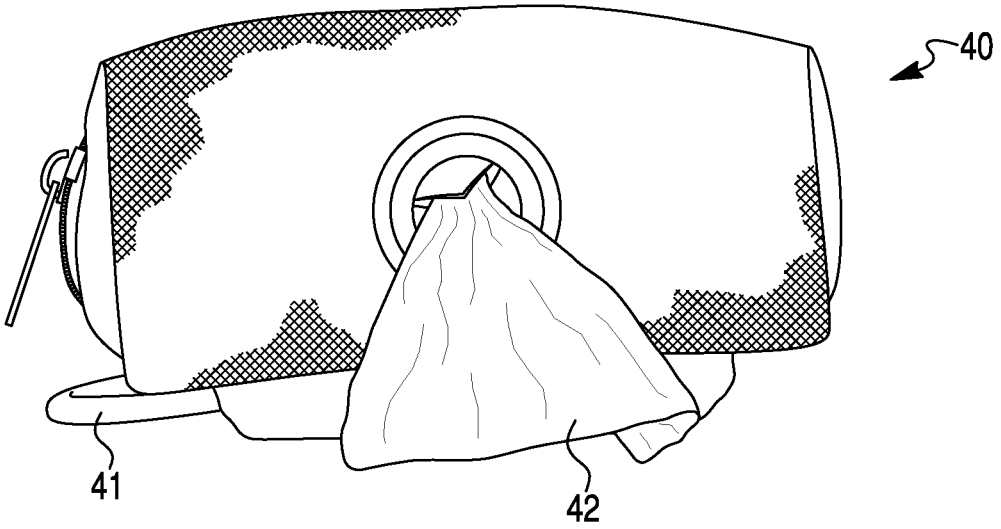
FIG. 6 is side view of a bag dispenser useable with the wearable storage device shown in FIG. 1.

Referring to FIG. 6, according to some aspects, the storage device 1 also includes a bag dispenser module 40 which includes a loop 41 and is thereby selectively attachable to the belt loop 5 in a modular manner to provide additional functionality. The bag dispenser 40 can be used by particular users (such as pet-watchers, walkers, etc.) to store bags 42 used to store and/or transport pet waste. The bag dispenser is configured to be attachable and/or removable from the belt loop 5. In some implementations, the bag dispenser 40 is formed integrally with the belt loop 5 or releasably securable to pouch 10 (e.g. by hook-and-loop fasteners, slide locks, etc.).

Figure 7:
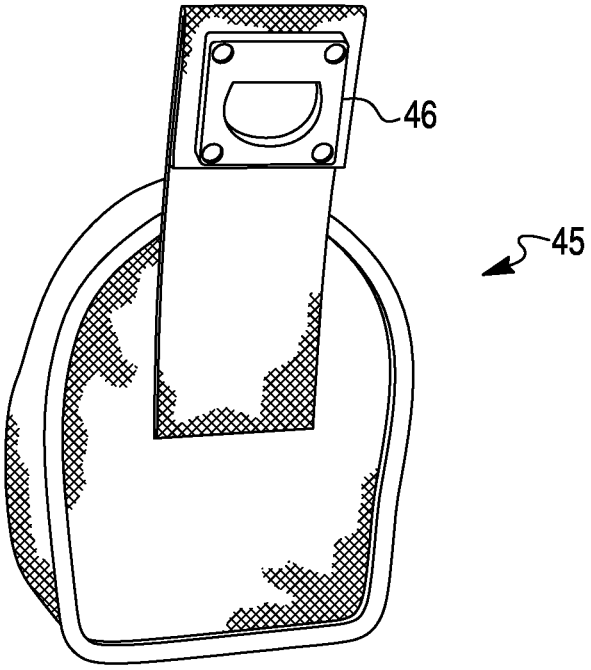
FIG. 7 is a perspective view of a sticker dispenser useable with the wearable storage device shown in FIG. 1.

Referring to FIG. 7, according to some aspects, the storage device 1 also includes a sticker dispenser module 45 which includes a loop or buckle 46 and is thereby selectively attachable to the belt loop 5 in a modular manner to provide additional functionality. The sticker dispenser 45 is useable by a user to store stickers or other similar accessories with which the user may use to mark objects, such as a pet-care calendar or the like. In some implementations, the sticker dispenser 45 is formed integrally with the belt loop 5 or pouch 10 or releasably securable to pouch 10 (e.g. by hook-and-loop fasteners, slide locks, etc.).

Figure 8:
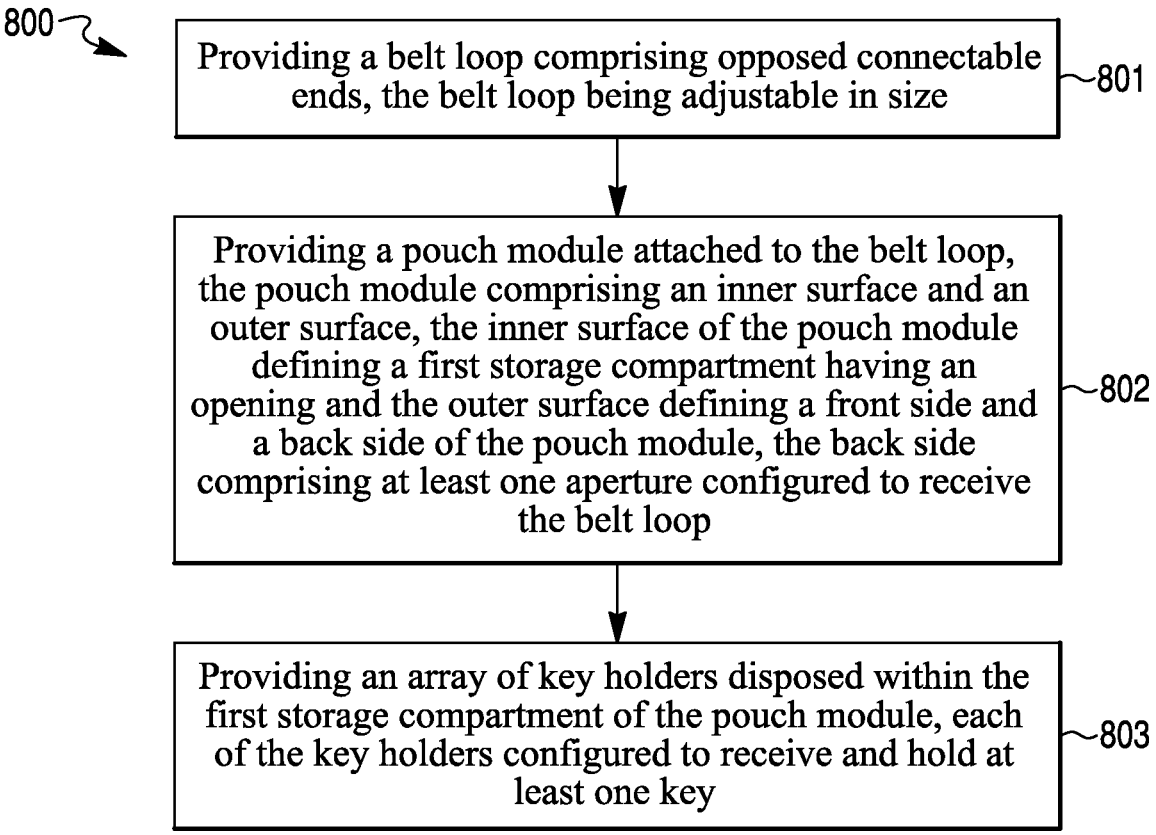
FIG. 8 is a flowchart illustrating a method of providing the wearable storage device shown in FIG. 1, according to an exemplary embodiment.

According to another exemplary embodiment of the present disclosure, a method 800 of providing a modular access-control storage device wearable by a user is disclosed. As shown in FIG. 8, the method 800 includes step 801 of providing a belt loop including opposed connectable ends, the belt loop being adjustable in size. The method 800 also includes the step 802 of providing a pouch module attached to the belt loop, the pouch module including an inner surface and an outer surface, the inner surface of the pouch module defining a first storage compartment having an opening and the outer surface defining a front side and a back side of the pouch module, the back side including at least one aperture configured to receive the belt loop. The method 800 also includes the step 803 of providing an array of key holders disposed within the first storage compartment of the pouch module, each of the key holders configured to receive and hold at least one key. According to one aspect of the method 800, the at least one aperture configured to receive the belt loop includes two apertures. According to another aspect of the method 800, each of the key holders is a retractable key holder. According to another aspect of the method 800, the array of key holders is a 2×5 array. According to another aspect of the method 800, the pouch includes a second storage compartment. According to another aspect of the method 800, the method 800 also includes providing a bag dispenser module releasably attached to the belt loop. According to another aspect of the method 800, the method 800 also includes providing a sticker dispenser module releasably attached to the belt loop. According to another aspect of the method 800, the pouch includes a flap configured to cover the opening of the first storage compartment, the flap including a sleeve configured to hold a writing instrument.

Figure 9:
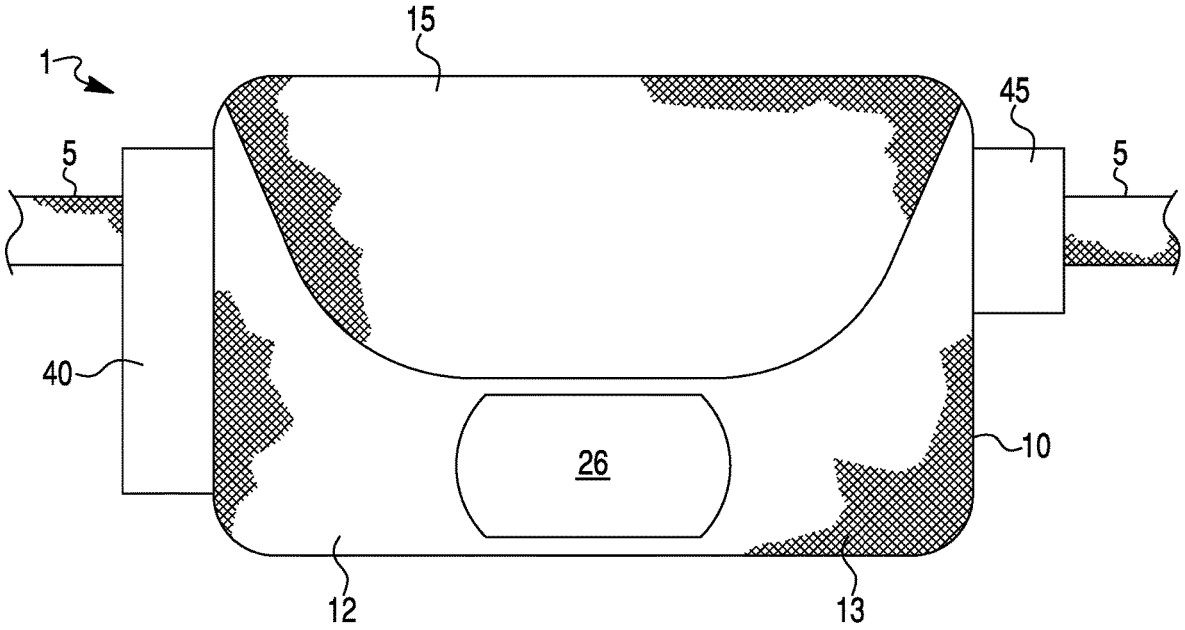
FIG. 9 is a front elevation view of a wearable storage device, according to an exemplary embodiment.

According to an exemplary embodiment, as shown in FIG. 9, a modular, wearable, access-control management and storage device 1' is shown having various modules engaged. The wearable, access-control management and storage device 1' includes an adjustable belt loop 5, and a pouch module 10, defining a storage compartment 20. The storage compartment 20 includes a plurality of connectors 22 arranged in an array and each of the plurality of connectors 22 is coupled to a retractable key holder (such as key holder 35 shown in FIG. 5). Each of the key holders 35 is configured to hold one or more keys associated with access control of a location (e.g., building, residence, etc.) or device (e.g. automobile, etc.). The keys are configured to remain in a predetermined, organized array within the safe confines of the pouch 10 until access is desired by a user. The pouch 10 may also include a writing instrument sleeve (such as sleeve 25 shown in FIG. 2A), a pet waste bag dispenser module 40, and/or a sticker dispenser module 45. Accordingly, the wearable, access-control management and storage device 1' is particularly suitable for use by pet-care professionals and building access/security-control professionals, among a wide variety of other potential users.

Figure 11:
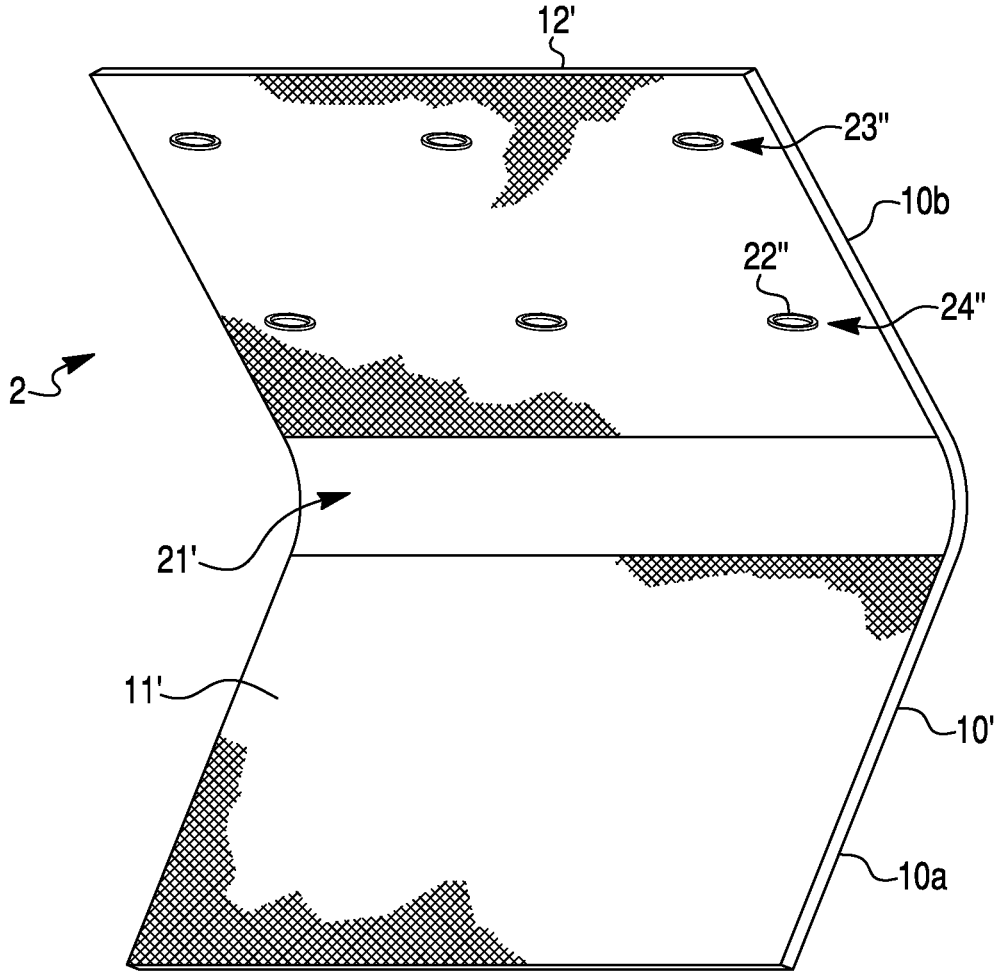
FIG. 11 is front perspective view of a storage device, according to an exemplary embodiment.

Referring now to FIG. 11, an additional exemplary embodiment of the present disclosure relates to storage device 2. The storage device 2 is as the storage device 1 described above, except for the differences herein described. The storage device 2 is configured to fit within a pocket of a user, for example, a conventionally sized pocket of an article of clothing. The storage device 2 includes a pouch (e.g., pouch module) 10' which includes an inner surface 11' and an outer surface 12'. The pouch 10' also includes a front face 10*a* and a back face 10*b*. The front face 10*a*, back face 10*b*, and the inner surface 11' together define a storage compartment 20'. Within the storage compartment 20', there are a plurality of connectors 22" which may be the same as the connectors 22, described above. The plurality of connectors 22" are disposed on and/or within the inner surface 11' such that the plurality of connectors 22" are arranged in an array and each of the plurality of connectors 22" is coupled to a retractable key holder (such as key holder 35 shown in FIG. 5). Each of the key holders 35 is configured to hold one or more keys associated with access control of a location (e.g., building, residence, etc.) or device (e.g. automobile, etc.). The keys are configured to remain in a predetermined, organized array within the safe confines of the pouch 10' until access is desired by a user. Although the plurality of connectors 22" shown in FIG. 11 are arranged in a 2×3 array including rows 23" and 24", the storage device 2 is not particularly limited to this implementation. For example, the connectors 22" are arranged in a 2×2 array, a 1×3 array, etc.

As utilized herein, the terms "approximately," "about," "substantially," and similar terms are intended to have a broad meaning in harmony with the common and accepted usage by those of ordinary skill in the art to which the subject matter of the disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of this disclosure as recited in the appended claims.

The terms "coupled," "connected," and the like are used herein to mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the position of elements (e.g., "top," "bottom," "above," "below," etc.) are merely used to describe the orientation of various elements in the Figures. It should be noted that the orientation of various elements may differ according to other exemplary embodiments and that such variations are intended to be encompassed by the present disclosure.

It is to be understood that although the present invention has been described with regard to embodiments thereof, various other embodiments and variants may occur to those skilled in the art, which are within the scope and spirit of the invention, and such other embodiments and variants are intended to be covered by corresponding claims. Those skilled in the art will readily appreciate that many modifications are possible (e.g., variations in sizes, structures, shapes and proportions of the various elements, mounting arrangements, use of materials, orientations, etc.) without materially departing from the novel teachings and advantages of the subject matter described herein. For example, the order or sequence of any process or method steps may be varied or re-sequenced according to alternative embodiments. Other substitutions, modifications, changes, and omissions may also be made in the design, operating conditions and arrangement of the various exemplary embodiments without departing from the scope of the present disclosure.

With respect to the use of substantially any plural and/or singular terms herein, those having skill in the art can translate from the plural to the singular and/or from the singular to the plural as is appropriate to the context or application. The various singular/plural permutations may be expressly set forth herein for clarity.

What is claimed is:

1. A wearable, access-control management and storage device, comprising:

a belt loop comprising opposed connectable ends, the belt loop being adjustable in size;

a pouch module coupled to the belt loop, the pouch module comprising a front panel, a back panel, and a flap coupled to the back panel, the front panel and the back panel defining a first storage compartment having an opening, the front panel comprising a cut-out contiguous with the opening;

a first snap-fit connector coupled to an inner surface of the back panel;

a second snap-fit connector coupled to the inner surface of the back panel; and a plurality of key holders, each of the plurality of key holders configured to be disposed within the first storage compartment of the pouch module, each of the plurality of key holders configured to receive and hold at least one key, the plurality of key holders comprising:

a first retractable key holder coupled to the first snap-fit connector, the first retractable key holder and the flap configured to cooperate to facilitate displacement of a first target key relative to the pouch module, between the front panel and the flap, and while a first lever arm of the first retractable key holder is holding the first target key and the first retractable key holder is coupled to the back panel; and a second retractable key holder coupled to the second snap-fit connector, the second retractable key holder and the flap configured to cooperate to facilitate displacement of a second target key relative to the pouch module, between the front panel and the flap, and independent of the first target key, while a second lever arm of the second retractable key holder is holding the second target key and the second retractable key holder is coupled to the back panel;

wherein the first lever arm is configured to receive the first target key, hold the first target key, and release the first target key;

wherein the second lever arm is configured to receive the second target key, hold the second target key, and release the second target key;

wherein the back panel comprises at least one aperture configured to receive the belt loop;

wherein the flap is operable between an open position where access into the storage compartment via the opening and the cut-out is facilitated and a closed position where the flap is coupled to the front panel such that the cut-out and the opening are covered by the flap and access into the storage compartment via the opening and the cut-out is prohibited;

wherein the flap is defined by a first perimeter comprising a first straight portion contiguous with the back panel, a first sloped portion contiguous with the first straight portion, a second straight portion contiguous with the first sloped portion, and a second sloped portion contiguous with the first straight portion and the second straight portion;

wherein the cut-out is defined by a second perimeter comprising a third sloped portion, a third straight portion contiguous with the third sloped portion, and a fourth sloped portion contiguous with the third straight portion; and wherein the third straight portion is parallel to the second straight portion.

2. The wearable, access-control management and storage device according to claim 1, wherein the at least one aperture configured to receive the belt loop comprises two apertures.

3. The wearable, access-control management and storage device according to claim 1, wherein the plurality of key holders are arranged in an array.

4. The wearable, access-control management and storage device according to claim 3, wherein the array is a 2×5 array.

5. The wearable, access-control management and storage device according to claim 1, wherein the pouch module comprises a second storage compartment.

6. The wearable, access-control management and storage device according to claim 1, further comprising a bag dispenser module coupled to the belt loop or the pouch module.

7. The wearable, access-control management and storage device according to claim 1, further comprising a sticker dispenser module coupled to the belt loop or the pouch module.

8. The wearable, access-control management and storage device according to claim 1, wherein the flap comprises a sleeve configured to hold a writing instrument.

9. A wearable, access-control management and storage device, comprising:

a strap configured to be worn by a user;

a pouch module coupled to the strap, the pouch module comprising a front panel, a back panel, and a flap coupled to the back panel, the front panel and the back panel defining a storage compartment having an opening, the front panel comprising a cut-out contiguous with the opening;

a removable platform housed within the pouch module, the removable platform including a plurality of snap-fit connectors; and a plurality of retractable key holders, each of the plurality of retractable key holders configured to receive and hold at least one key and coupled to one of the plurality of snap-fit connectors, the plurality of retractable key holders comprising:

a first retractable key holder coupled to a first snap-fit connector of the plurality of snap-fit connectors, the first retractable key holder and the flap configured to cooperate to facilitate displacement of a first target key from the storage compartment through the opening;

a second retractable key holder coupled to a second snap-fit connector of the plurality of snap-fit connectors, the second retractable key holder and the flap configured to cooperate to facilitate displacement of a second target key from the storage compartment through the opening and independent of the first retractable key holder;

wherein the flap is operable between an open position where access into the storage compartment via the opening and the cut-out is facilitated and a closed position where the flap is coupled to the front panel such that the cut-out and the opening are covered by the flap and access into the storage compartment via the opening and the cut-out is prohibited;

wherein the cut-out is defined by a first perimeter;

wherein the flap is defined by a second perimeter that mirrors the first perimeter;

wherein the first retractable key holder comprises a first depressible clip configured to receive the first target key, hold the first target key, and release the first target key; and wherein the second retractable key holder comprises a second depressible clip configured to receive the second target key, hold the second target key, and release the second target key.

10. The wearable, access-control management and storage device according to claim 9, wherein:

the first perimeter comprises a first sloped portion, a first straight portion contiguous with the first sloped portion, and a second sloped portion contiguous with the first straight portion;

the second perimeter comprises a second straight portion contiguous with the back panel, a third sloped portion contiguous with the second straight portion, a third straight portion contiguous with the third sloped portion, and a fourth sloped portion contiguous with the second straight portion and the third straight portion; and the first straight portion is parallel to the third straight portion.

11. A method of providing a wearable, access-control management and storage device, the method comprising:

providing a belt loop comprising opposed connectable ends, the belt loop being adjustable in size;

providing a pouch module attached to the belt loop, the pouch module comprising a front panel, a back panel, a first snap-fit connector coupled to an inner surface of the back panel, a second snap-fit connector coupled to the inner surface of the back panel, and a flap coupled to the back panel and having a first shape, the front panel and the back panel defining a first storage compartment having an opening, the front panel comprising a cut-out contiguous with the opening and having a second shape geometrically similar to the first shape, the back panel comprising at least one aperture configured to receive the belt loop; and providing an array of key holders disposed within the first storage compartment of the pouch module, each of the array of key holders configured to receive and hold at least one key, the array of key holders comprising:

a first extendable key holder coupled to the first snap-fit connector and configured to facilitate removal of a first target key from the pouch module, the first extendable key holder comprising a first depressible clip configured to receive the first target key, hold the first target key, and release the first target key; and a second extendable key holder coupled to the second snap-fit connector and configure to facilitate removal of a second target key from the pouch module, independent of the first target key, the second extendable key holder comprising a second depressible clip configured to receive the second target key, hold the second target key, and release the second target key;

wherein the flap is operable between an open position where access into the storage compartment via the opening and the cut-out is facilitated and a closed position where the flap is coupled to the front panel such that the cut-out and the opening are covered by the flap and access into the storage compartment via the opening and the cut-out is prohibited.

12. The method according to claim 11, wherein the at least one aperture configured to receive the belt loop comprises two apertures.

13. The method according to claim 11, wherein the array of key holders is a 2×5 array.

14. The method according to claim 11, wherein the pouch module comprises a second storage compartment.

15. The method according to claim 11, further comprising providing a bag dispenser module releasably attached to the belt loop.

16. The method according to claim 11, further comprising providing a sticker dispenser module releasably attached to the belt loop.

17. The method according to claim 11, wherein the flap comprises a sleeve configured to hold a writing instrument.

* * * * *